US007243963B2

(12) United States Patent
De Lima Castro

(10) Patent No.: US 7,243,963 B2
(45) Date of Patent: Jul. 17, 2007

(54) SECURITY SEAL

(75) Inventor: Andre De Lima Castro, Rio de Janeiro (BR)

(73) Assignee: ELC Produtos de Seguranca Industria E Commercio Ltda., Rio de Janeiro (BR)

( * ) Notice: Subject to any disclaimer, the term of this patent is extended or adjusted under 35 U.S.C. 154(b) by 0 days.

(21) Appl. No.: 11/216,159

(22) Filed: Sep. 1, 2005

(65) Prior Publication Data

US 2006/0049646 A1 Mar. 9, 2006

(30) Foreign Application Priority Data

Sep. 6, 2004 (BR) ..... 0403815

(51) Int. Cl.
*E05F 1/08* (2006.01)

(52) U.S. Cl. ..... 292/315; 292/319; 292/323; 292/307 R

(58) Field of Classification Search ..... 292/315–327, 292/307 R, 329; 24/136 A, 16 R, 706.8, 24/136 R, 115 N, 115 L
See application file for complete search history.

(56) References Cited

U.S. PATENT DOCUMENTS 1,577,678 A * 3/1926 Behrman ..... 292/325
3,770,307 A * 11/1973 Van Gompel ..... 292/307 R
4,681,356 A * 7/1987 Brammall ..... 292/327
4,747,631 A * 5/1988 Loynes et al. ..... 292/307 R
5,222,776 A 6/1993 Georgopoulos et al.
5,352,003 A * 10/1994 Bystry ..... 292/323
6,155,617 A * 12/2000 Kuenzel ..... 292/318
6,345,847 B1 2/2002 Dreisbach et al.
6,540,273 B2 * 4/2003 Brammall et al. ..... 292/315
6,550,830 B2 * 4/2003 Kueznel ..... 292/327
6,933,847 B2 * 8/2005 Feibelman ..... 340/572.1

* cited by examiner

*Primary Examiner*—Brian E. Glessner
*Assistant Examiner*—Mark Williams
(74) *Attorney, Agent, or Firm*—Finnegan, Henderson, Farabow, Garrett & Dunner, L.L.P.

(57) ABSTRACT

A security seal having a locking body and a thread having a first end attached to the body and a second free end, the body having an entry opening for insertion of the second end of the thread and further, inside it a locking device that permits passage of the second end of the thread in the insertion direction and prevents withdrawal of the thread in the opposite direction. The locking device is in the form of wedges (14) to open and close the passage for the thread (2). The wedges (6) are linked to the rest of the body by spring connection portions (20) and molded together with the body in order to facilitate its manufacture.

12 Claims, 6 Drawing Sheets

SECURITY SEAL

The present invention relates to a security seal of the type that comprises a locking body and a thread having a first end attached to the body and a second free end, the body having an entry opening for inserting the second end of the thread and further, in its interior, locking means that allow the passage of the second end of the thread in the direction of insertion and prevent it from being pulled out in the opposite direction.

There are many prior art security seals of this type. Some have a low level of security because the locking means are quite easily accessible from the outside, while others, of a high security level, suffer from expensive design and/or material used in their manufacture. Although some of them are of good quality and a high level of security, they are composed of several parts, including springs, balls and the like, which, in addition to the high cost of the starting materials, involve intensive labor or complex machinery for assembly. Examples of seals of this type can be found in U.S. Pat. Nos. 5,222,776 and 6,345,847 B1.

OBJECT OF THE PRESENT INVENTION

The present invention aims at providing a security seal of the type mentioned above, which is easy to manufacture at a reduced cost and without impairing the degree of security provided by the product.

SUMMARY OF THE INVENTION

According to the present invention, in a security seal of the above-defined type, the locking means comprise:

first and second fixed and substantially flat surfaces facing each other, but angularly diverging from each other in the thread-insertion direction from a region adjacent the entry opening; and at least one movable wedge element having, on one side, a substantially flat guiding surface, adapted to slide along said first fixed surface, and a thread-locking surface on an opposite side of the wedge element, the thread-locking surface being angularly divergent with respect to the guiding surface in the direction of thread insertion and defining a side of a passage for the thread inside the body; the movement of the thread in the direction of insertion through said opening causing displacement of the guiding surface from the wedging element along the first fixed surface in the direction of insertion, with a consequent increase in the width of the passage for the thread, and the movement of the thread in the opposite direction toward said opening causing displacement of the guiding surface from the wedging element also in this direction, thus narrowing the passage for the thread on the side of the thread-locking surface and locking the thread against its withdrawal from the body, wherein:

said opening has a cross-section that is substantially equal to that of said thread.

In the presently preferred embodiment of this invention, the seal body comprises a first bottom part, a cover part and an intermediate part forming a peripheral side wall of the body, which is closed on one side of the bottom part and on the other side by the cover part. One of the bottom part and cover part has a pair of protrusions having the first and second fixed surfaces facing each other, while the intermediate part is formed with the opening of for the thread, and further having the wedging elements joined to it for flexible connections with spring action, so that, when the intermediate part is closed by the bottom and cover parts, the two wedging elements are received with their respective guiding surfaces resting on the respective fixed surfaces of the protrusions and with their thread-locking surfaces facing each other, thus defining the passage for the thread. The three parts are definitively joined to each other, thus preventing disassembly without leaving tampering signs.

In one of the preferred embodiments, the thread is a separate element, usually made of wire, the first end of the thread passing through a second opening into said body and is anchored there. In this case, at the proximity of its first end, the thread passes through a winding path that prevents it from being withdrawn.

In another preferred embodiment, the thread is made of the same plastic material of the body, preferably polycarbonate, being injection molded together with the body.

These and other characteristics of the invention will be better understood from the detailed description hereinafter, given by way of example, with reference to the attached drawings.

DETAILED DESCRIPTION OF THE PREFERRED EMBODIMENTS OF THE INVENTION

Figure 1:
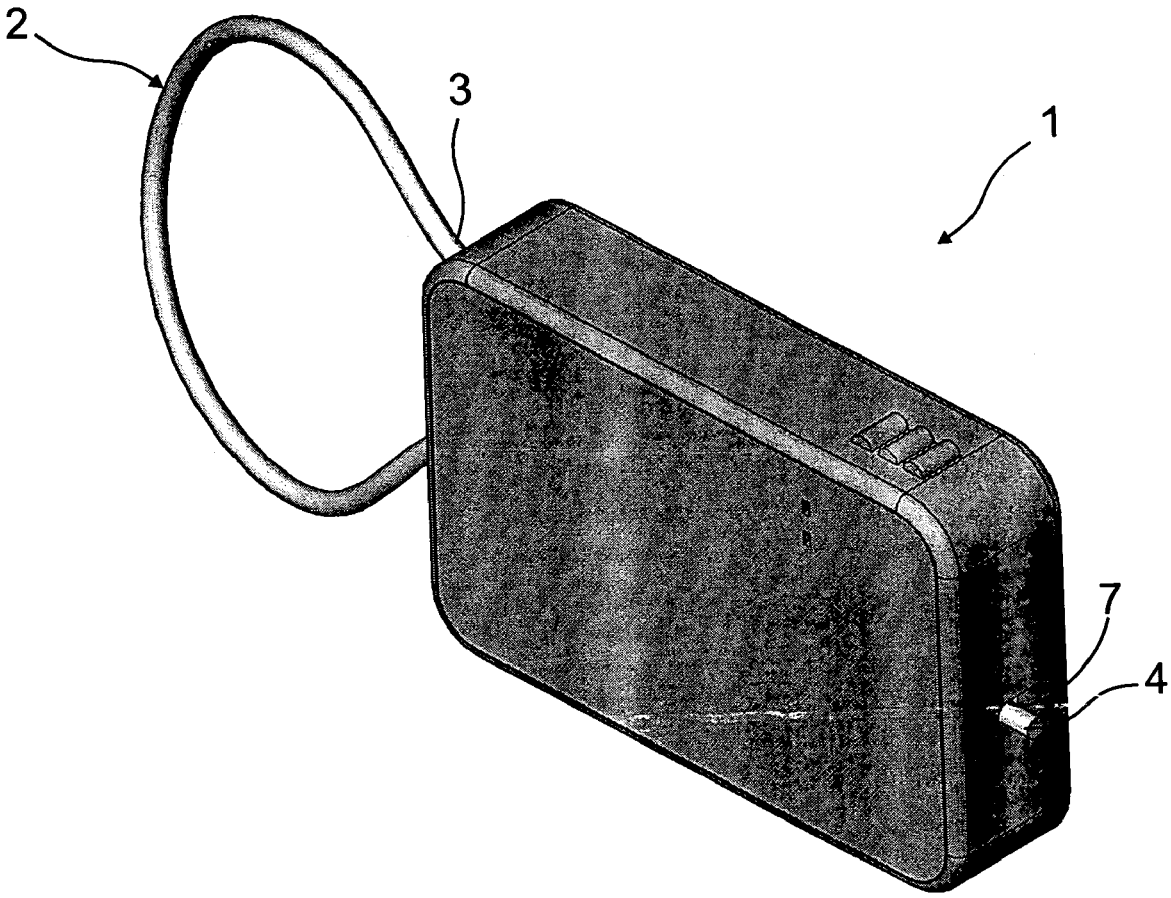
FIG. 1 is a perspective view of a security seal having the presently preferred external design, for carrying out the present invention, in the closed and sealed embodiment.

FIG. 1 of the drawings shows a security seal of the type mentioned above, in the form of a substantially parallelepipedal body of box 1, provided with a sealing thread 2. An end 3 of the thread 2 is attached to the body 1 and the other end 4 passes through an opening 5 between a pair of locking wedges 6, where it becomes fixed, and out of a second opening 7 (see also FIG. 2).

The body 1 is made from plastic material, preferably polycarbonate, and in one of the preferred embodiments the thread 2 is made from the same material, having been injection molded simultaneously with the body. In one preferred embodiment, however, the thread 2 is made of wire, and may also be a wire composed of a central thread with another thinner thread helically wound around it in order to improve the locking of the thread against wedges 6. In this case or even when another type of thread (nylon, polycarbonate, etc.) is used as a separate part, the first end 3 of the thread enters into another opening 8 in body 1, adjacent opening 5, and passes along a sinuous path inside the body to be anchored there (see FIGS. 2, 3 and 4).

Figure 2:
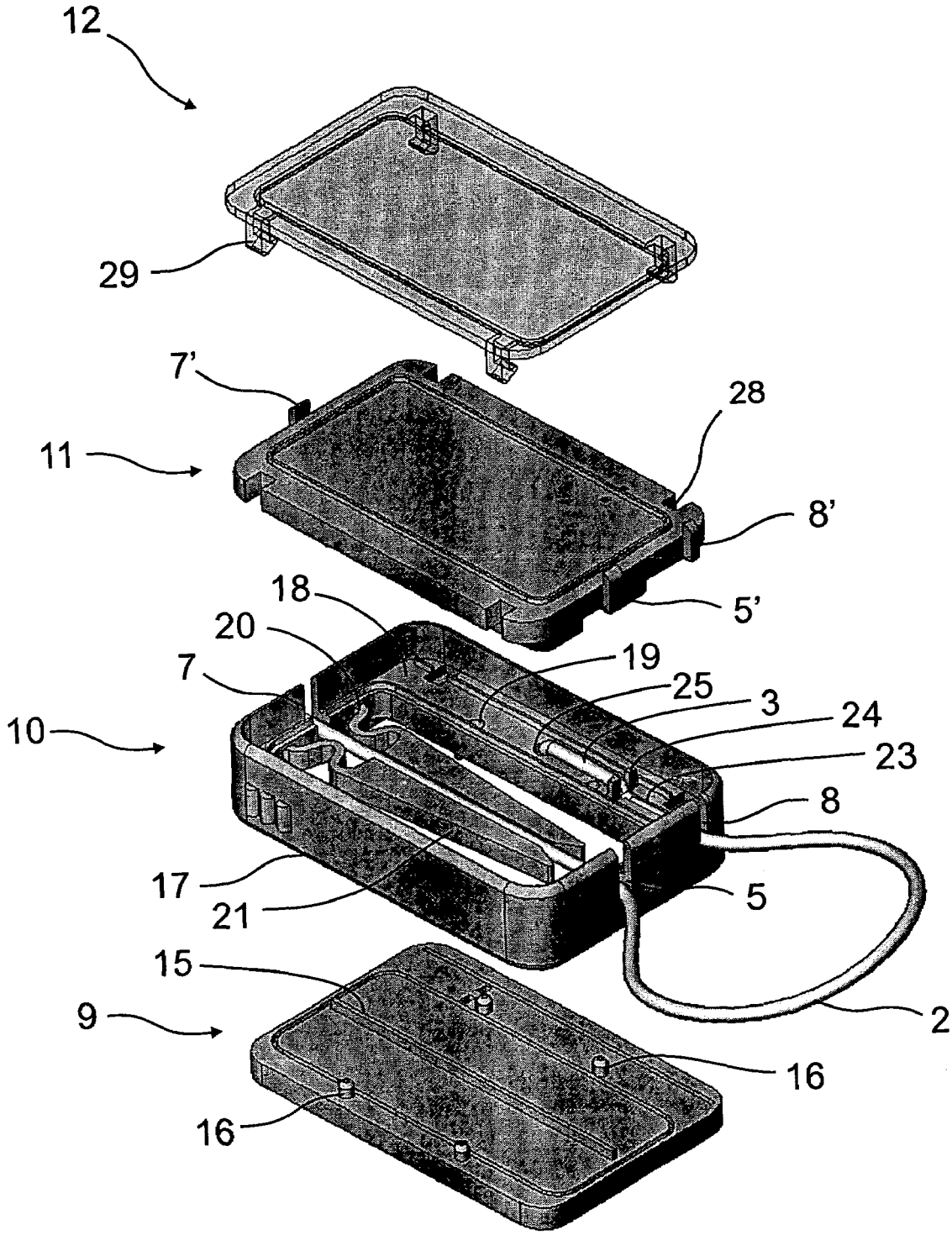
FIG. 2 is a perspective "exploded" top view in detail of the security seal shown in FIG. 1, according to the presently more preferred embodiment of the invention.
Figure 3:
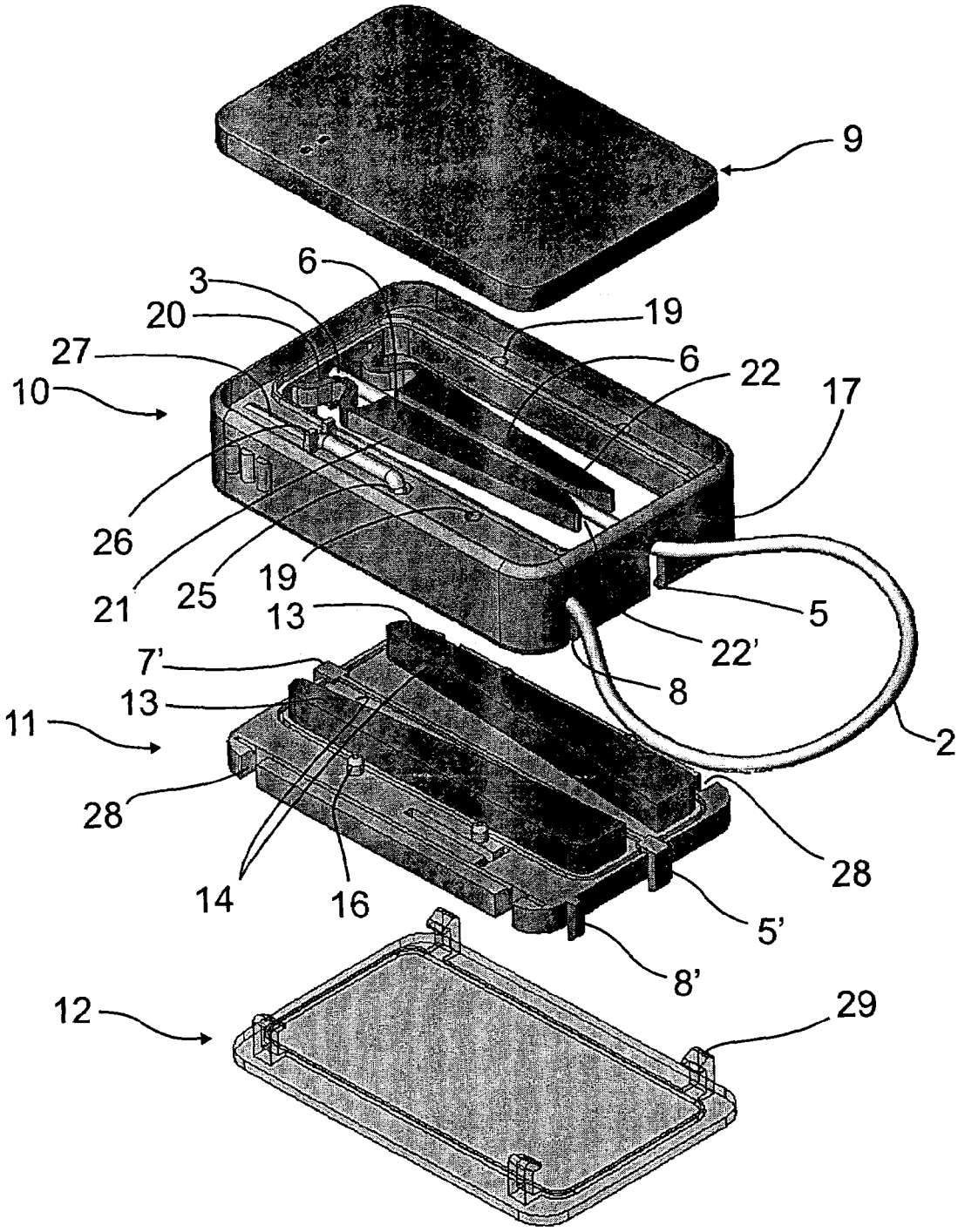
FIG. 3 is similar to FIG. 2 in bottom perspective.

Considering now FIGS. 2 and 3, the security seal body 1 is seen to be comprised of four parts, namely a bottom part 9, an intermediate part 10, a cover part 11 and an outer cover part 12. The cover part 11 of rectangular external shape is formed, in its lower surface, with two protrusions 13 having two vertical and substantially flat fixed surfaces 14 facing each other, which diverge angularly from right to left in FIG. 3. These surfaces 14 serve as guides for the locking wedges 6, as will be seen later.

The top surface of the bottom part 9, in turn, is provided with a protrusion 15, which is of less height than that of protrusions 13 and is in the form of a longitudinal rib.

Both the bottom part 9 and the cover part 11 are provided with four mounting pins 16 for its initial mounting on the intermediate part 10.

The intermediate part 10 comprises an external peripheral wall 17 of body 1, the internal periphery of which corresponds to the external periphery of bottom part 9, so that the latter can be fitted to the intermediate part 10 at the time of assembling the seal. The intermediate part 10 further comprises an intermediate platform 18 provided with four mounting bores 19 (only two of them are visible in FIGS. 2 and 3) for receiving the pins 16 of bottom part 9 and cover part 11. The intermediate platform 18 is through-bored in a generally central region and, in the through-bored region, the two locking wedges 6 are joined at their ends to the rest of the intermediate part 10 by respective springs 20.

FIGS. 2 and 3 also show that the intermediate part 10 is formed with slots that, at the time of assembling the seal, are partly closed to form the respective openings 5, 7 and 8 for passage of thread 2.

Each locking wedge 6 has an external wedge surface 21 that, when the bottom part 9 is fitted to the intermediate part 10, rests against the respective guide surface 14 and can slide along the latter. Thus, the wedge surfaces 21 in the assembled embodiment diverge from each other according to the second divergence angle defined by guide surfaces 14. The other side of each wedge 6 comprises a substantially flat locking surface 22, so that, in the assembled condition of the seal, the two surfaces 22 will also be parallel to each other and separated only by rib 15 on bottom part 9. At their ends adjacent the opening 5 for the thread, surfaces 22 diverge so as to define an opening 22' between the wedges 6 for the thread or wire 2. The spring connections or portions 20 urge the wedges 6 to the right in FIGS. 2 and 3, in order to hold them against rib 15. The space between the wedges defines a passage for the thread or wire 2, laterally limited by the locking surfaces 22, from below by rib 15 and from above by the lower surface of cover part 11.

Figure 4:
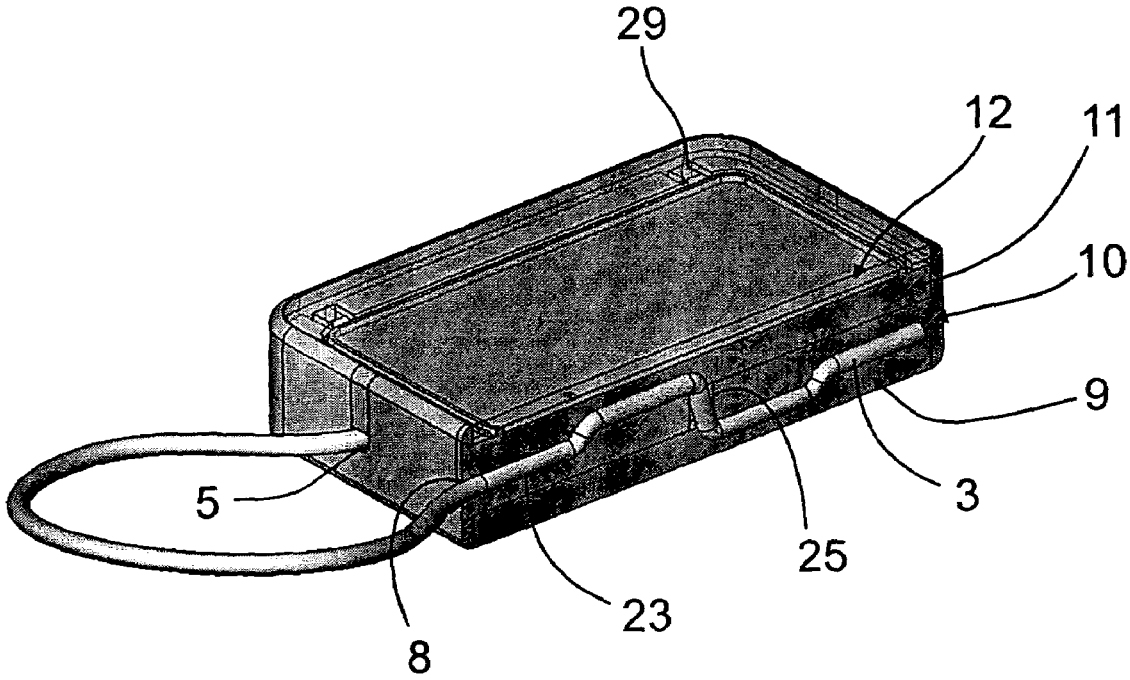
FIG. 4 is a cross-sectional and perspective view of the seal of FIGS. 2 and 3, already closed and sealed, showing the detail of the anchorage of the sealing thread.

The intermediate platform 18 of the intermediate part is further formed with a small groove 23 aligned with slot 8, a pair of lateral protrusions 24 at the end of groove 23, a through bore 25 having the diameter of the thread 2 (FIGS. 2 and 4) and, on the lower surface of platform 18, another pair of lateral protrusions 26 and a second groove 27 (FIGS. 3 and 4). As can be seen from FIGS. 3 and 4, the end 3 of the thread or wire is pre-bent so that it can easily be inserted through the slot 8, received in groove 23, secured between protrusions 24, passed through bore 25, secured between protrusions 26 and finally received in the lower groove 27, thus following a sinous path that, at the time of assembling the seal, ensures the definitive anchorage of the end 3 of wire 2 within the seal.

The cover part 11, with bottom part 9, is sized to be fitted to the intermediate part 10 above platform 19. It is formed with three protrusions 5', 7' and 81 which, when mounting body 1, partially close the respective slots in the peripheral wall 17 of the intermediate part 10, in order to define openings 5, 7, and 8 which correspond substantially to the diameter of wire 2. The cover part 11 has four cutouts 28 for receiving four corresponding claws 29 on the outer cover part 12.

In order to assemble the seal, wire 2 is first anchored to intermediate part 10, as described above, and the bottom part 9 and cover part 11 are then fitted to the intermediate part with the mounting pins 16 inserted in their respective mounting bores 19. Once mounted, the assembly is subjected to an ultra-sound welding operation, which makes it into a single piece, which cannot be disassembled without damage or signs of tampering.

The outer cover part 12 is an optional part, preferably transparent, which is fitted to the seal after the latter has been assembled, serving to permit insertion of a label, quality seal or the like on the top surface of cover part 11.

Figure 5:
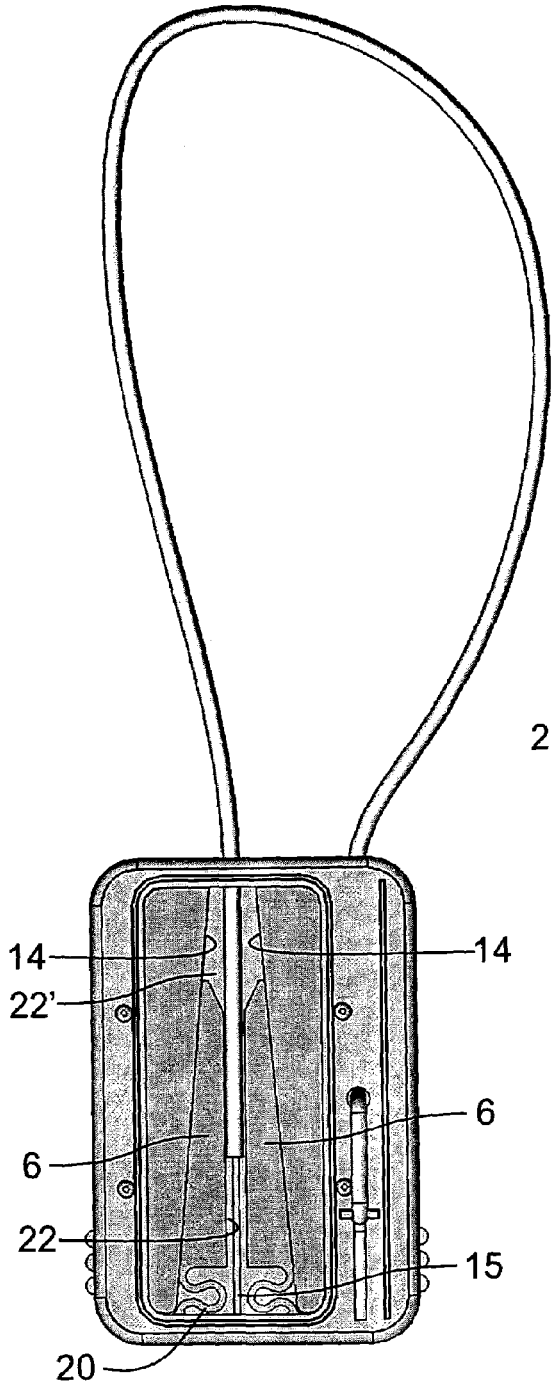
FIG. 5 is a bottom view of the seal, with the bottom part removed, showing the initial introduction of the thread into the seal body.
Figure 6:
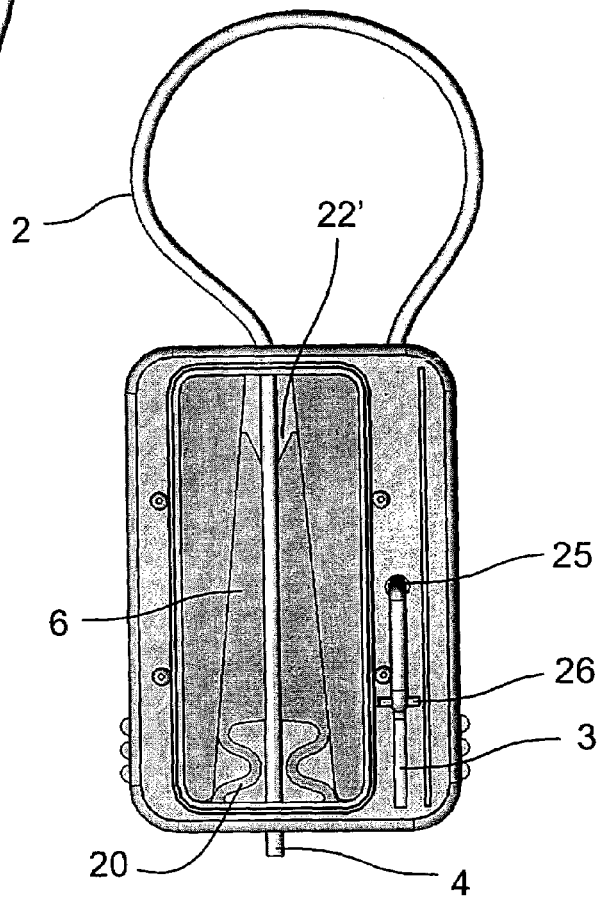
FIG. 6 is a view similar to that of FIG. 5, but with the thread already in its definitive sealing position in the seal.

The use of the seal is schematically illustrated in FIGS. 5 and 6. In FIG. 5, the end 4 of wire 2 has already been introduced through opening 5 and inserted between wedges 6, urging the latter back to the left (in the Figure against the force of its springs 20. This means that the wedge surfaces 21 slide to the left along guide surfaces 14, slightly opening the passage between the locking surfaces 22 of the wedges. This allows wire 2 to pass from inlet opening 5 as far as outlet opening 7 in the seal body 1 and to appear on the other side of the seal, as can be seen in FIGS. 1 and 6. The user of the seal then pulls the end 4 of wire 2 until the loop formed by the wire reaches the desired size or until the desired tension is achieved. At this moment (see FIG. 6), be releases the end 4 (or stops applying force to insert the wire from the other side of the body 1) and pulls the wire in the opposite direction. This together with the force of springs 20 causes the wedges 6 to be displaced slightly to the right, closing under wedge action the passage between the locking surfaces 22 and preventing the wire 2 from being withdrawn from the seal. This effect may even be increased if the locking surfaces 22 are slightly rough or serrated in order to grasp the wire or thread.

Figure 7:
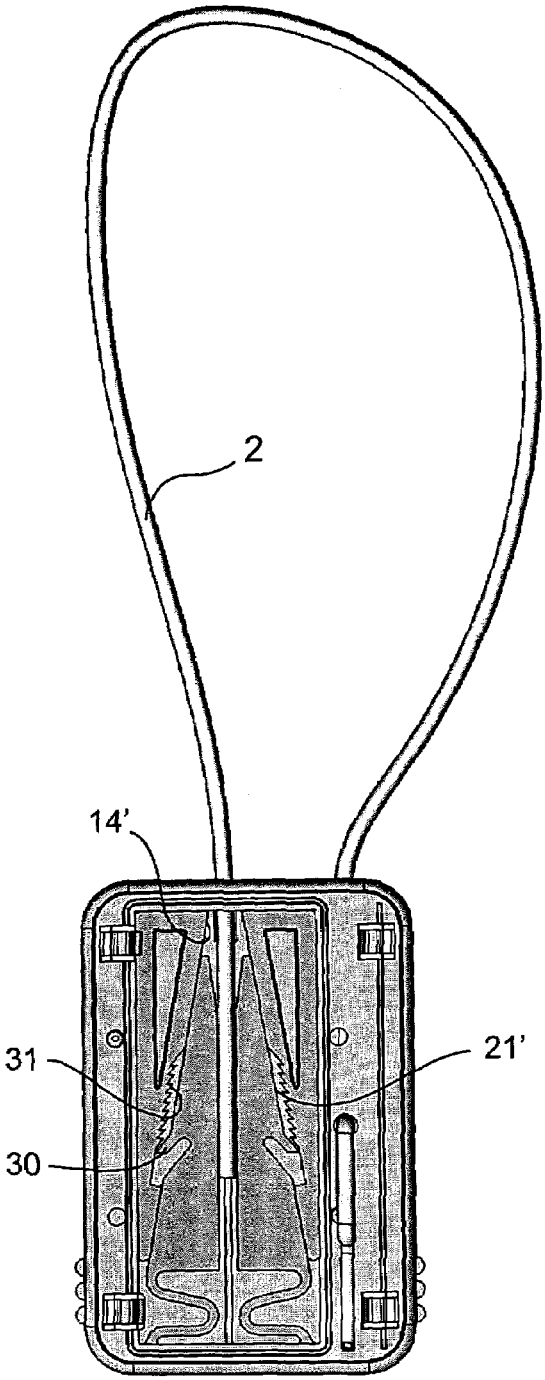
FIG. 7 is a bottom view similar to that of FIG. 5 but of a presently preferred embodiment in which ratchet means are included between the fixed and guide surfaces of the seal.
Figure 8:
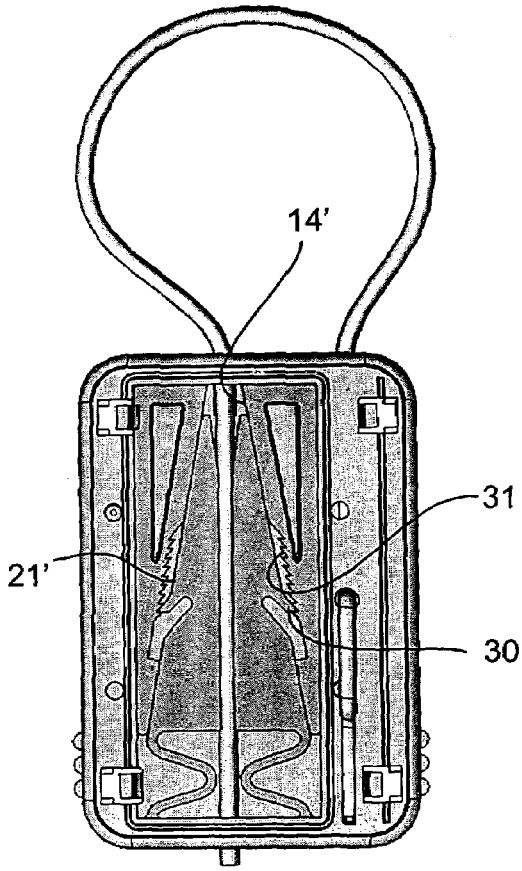
FIG. 8 is a view similar to that of FIG. 7, but with the thread in its definitive sealing position.

This effect becomes even more apparent in a presently preferred embodiment, illustrated in FIGS. 7 and 8, in which ratchet means are provide between the guide surfaces and the wedge surfaces. Thus, with reference to those Figures, each wedge surface 21' is formed with a single tooth 30 and each guide surface 14' has a recess in which a series of ratchet teeth 31 are formed for cooperation with the corresponding tooth 30. As will be seen from FIG. 7, on initial insertion of thread or wire 2 between the locking surfaces 22; the two teeth 30 are out of cooperation with their respective ratchet teeth 31 on guide surfaces 14' and the wedges 6 can slide longitudinally, compressing springs 20. Once the end of wire 2 exits opening 5 and the seal operation is to be terminated by pulling the wire 2 back slightly, not only do the wedges slide back to lock the wire within the seal but also the ratchet action between teeth 30 and 31 ensures that the grip on wire 2 cannot be released by the wedges moving back again towards opening 5.

The seal described above and illustrated in the drawings exhibits a high degree of security, coupled with low production and assembly costs. The bottom part 9, intermediate part 10 and cover part 11 may be molded in a single plastic injection operation, the cover part 12 being a separate part. The assembly operation involves putting in the wire, followed by simply fitting the three parts together and then welding by ultra-sound.

It will be understood that the seals illustrated and described herein are only intended to exemplify the invention, various modifications being possible without departing from the spirit and scope of the present invention. For instance, it would not be essential for the wire of thread to pass right through to the other side of the seal body, it being sufficient for its end to remain within the body. It is not essential that there are two wedges, the same effect being possible with a single wedge. The protrusions 13, which form the fixed surfaces 14 and serve as guides for the movable wedges could be formed on the top surface of the bottom part 11, instead of the bottom surface of the cover part 11, without changing the functionality of the seal. Equally, the rib 15 may be both on the bottom part 9, as illustrated in the drawings, and on the cover part 11.

In addition, the manner of anchoring the end 3 of the wire could be different. As already said, the thread may be made from the same material as the seal body, being integral with the latter, thus facilitating the manufacture and assembling operation even further. There are other ways of joining the body parts, including electronic welding or even with some special glues.

In other words, the scope of the invention should not be affected by these and other variations that might occur to a person skilled in the art.

The invention claimed is:

1. A security seal comprising a locking body and a thread having a first end attached to the body and a second free end, the body having an entry opening for inserting the second end of the thread into the body and locking means in the interior of the body that allow the second end of the thread to pass in the insertion direction and prevent it from being withdrawn in the opposite direction, said locking means having:

first and second fixed and substantially flat surfaces facing each other, but angularly diverging from each other in said thread-insertion direction, from a region adjacent said opening;

at least one movable wedge element having, on one side, a substantially flat guide surface, adapted to slide along said first fixed surface, and a substantially flat thread-locking surface, on an opposite side of the wedge element, the thread-locking surface being angularly divergent with respect to the guide surface in the thread-insertion direction and defining one side of a passage for the thread within said body, the movement of the tread in the insertion direction through said opening causing displacement of the guide surface of the wedge element along the first fixed surface in the insertion direction, with the consequent increase of the width of the passage for the thread, and the movement of the thread in the opposite direction towards said opening causing displacement of the guide surface of the wedge element also in this direction, thus narrowing the passage for the thread on the side of the thread-locking surface and locking the thread against its withdrawal from the body, said opening having a cross-section substantially equal to that of said thread; and flexible spring means having a first end integrally connected to said body and a second opposite end integrally connected to said at least one moveable wedge element so as to permit said displacement in the thread-insertion direction and in the opposite direction, said at least one moveable wedge element, said spring means and at least a part of said body comprising a single infection molded part.

2. The security seal according to claim 1, further comprising a second wedge element and a second flexible spring means, respectively, substantially identical to the at least one moveable wedge element and said flexible spring means, but in mirror image, said passage for the thread being defined between thread-locking surfaces of the at least one moveable and second wedge elements.

3. The security seal according to claim 2, wherein said body has a thread-exit opening in a position corresponding to an end of said thread passage that is distant from said entry opening.

4. The security seal according to claim 3, wherein said first end of the thread passes through a second entry opening in said body and is anchored there.

5. The security seal according to claim 2, wherein said first end of the thread is integral with at least a part of the body.

6. The security seal according to claim 2, wherein said body comprises:

a first bottom part;

a cover part; and an intermediate part forming a peripheral side wall of the body, being closed on one side by the bottom part and on the other side by the cover part, wherein:

one of said bottom part and cover part has a pair of protrusions that have said first and second fixed surfaces facing each other;

the intermediate part is formed with said entry opening, said wedge elements and said spring means, so that, when the intermediate part is closed by said bottom part and said cover part, the two wedge elements are received with their respective guide surfaces resting against the respective first and second fixed surfaces on said protrusions and with their thread-locking surfaces facing each other, thus defining the passage for the thread; and the first, cover and intermediate parts are permanently joined to each other, to prevent disassembly without any sign of tampering.

7. The security seal according to claim 6, wherein said pair of protrusions are formed on a lower surface of the cover part.

8. The security seal according to claim 6, wherein said first, cover and intermediate parts are produced by plastic injection and joined to each other by ultra-sound welding.

9. The security seal according to claim 8, wherein the intermediate part is formed with a second entry opening in said body through which said first end of the thread passes, the thread in the proximity of its first end passing along a sinuous path that prevents it from being withdrawn from the body.

10. The security seal according to claim 9, wherein the intermediate part has a flat portion parallel to the cover part and the bottom part, formed with a through bore, and the thread in the proximity of its first end passes over a first side of said flat portion, through said bore and over the opposite side of the flat portion, thus defining said sinuous path.

11. The security seal according to claim 6, wherein the cover part and the bottom part have peripheries of substantially the same dimensions as upper and lower peripheries of the peripheral side wall of the body, formed by the intermediate part, and the cover part and the bottom part are fitted to the intermediate part.

12. The security seal according to claim 6, further comprising a transparent outer cover applicable to the body to permit introduction of identification matter between the body and the outer cover.

* * * * *